US006135896A

United States Patent [19]

Miao et al.

[11] Patent Number: 6,135,896

[45] **Date of Patent: *Oct. 24, 2000**

[54] PUTTER CLUB

[75] Inventors: Tiejun Miao; Masatake Kawaguchi, both of Kanagawa Prefecture, Japan

[73] Assignee: Nippon Shaft Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/132,049

[22] Filed: Aug. 11, 1998

[51] Int. Cl.[7] ..... A63B 53/02

[52] U.S. Cl. ..... 473/313; 473/292; 473/340

[58] Field of Search ..... 473/292, 294, 473/296, 297, 298, 300, 340, 313

[56] References Cited

U.S. PATENT DOCUMENTS

| | | | |
|---|---|---|---|
| 3,679,207 | 7/1972 | Florian | 473/340 |
| 4,163,554 | 8/1979 | Bernhardt | 473/313 |
| 4,203,598 | 5/1980 | Stuff et al. | 473/292 |
| 5,188,361 | 2/1993 | Coombe | 473/300 |
| 5,632,691 | 5/1997 | Hannon et al. | 473/292 |
| 5,649,870 | 7/1997 | Harrison | 473/239 |
| 5,730,661 | 3/1998 | Kozub | 473/294 |

FOREIGN PATENT DOCUMENTS

| | | |
|---|---|---|
| 63249583 | 10/1988 | Japan . |
| 1138476 | 9/1989 | Japan . |
| 4279181 | 10/1992 | Japan . |
| 588569 | 12/1993 | Japan . |
| 3000793 | 8/1994 | Japan . |
| 8117369 | 5/1996 | Japan . |
| 2247178 | 2/1992 | United Kingdom . |

*Primary Examiner*—Kien T. Nguyen
*Attorney, Agent, or Firm*—Ostrolenk, Faber, Gerb & Soffen, LLP

[57] ABSTRACT

The present invention provides a putter club 10 which minimizes the reaction from the golf ball 5 during putting, effectively and appropriately transmits the putting force to the golf ball 5, and provides an effective sense of putting distance.

The present invention is characterized by the location of the center of rotation P (center of instantaneous impact or shock) of the putter club 10 during putting at a position on the grip 4 (especially locating it on the grip area 6), by this arrangement minimizing the reaction from the putter club to the hands, and by the location of the center of rotation P of the shaft 2 during putting on the grip 4, making it easy to control the entire putter club.

10 Claims, 5 Drawing Sheets

$$L1 = \frac{I}{M \cdot L2} \quad \text{------} \quad \text{equation(1)}$$

$$I = \sum m_i \cdot d_i^2 - M \cdot G^2 \quad \text{-----} \quad \text{equation(2)}$$

$$G = \frac{1}{M} \sum m_i \cdot d_i \quad \text{------} \quad \text{equation(3)}$$

$$L3 = Z - (L1 + L2) \quad \text{-----} \quad \text{equation(4)}$$

PUTTER CLUB

BACKGROUND OF THE INVENTION

1. Field of the Invention

The present invention relates to a putter club, and more particularly to a putter club wherein the shock of impact with the golf ball during putting is minimized and which can allow more appropriate putting.

2. Description of the Related Art

Before now, it was generally thought that the flexibility of the shaft of a driver, iron, or putter club has little influence at the time of impact, and that the club head acts independently from the shaft and grip. Consequently, it was a matter of course that attention was given to only the club head and especially to devising the sweet spot, which is the center of gravity.

However, because of the low shock during putting, the flexibility of the shaft is not used in a putter club, as it is in a driver or iron. As a result, it was necessary to consider the "grip-shaft-head" as a single rigid body at the time of impact. Various problems with a conventional putter club 1 are explained on the basis of FIGS. 8 and 9.

FIG. 8 is a side view of the putter club 1 during putting. FIG. 9 is a detail of the putter club 1 during putting. The putter club 1 comprises a shaft 2, a head 3 mounted on one end, the top end of this shaft 2, and a grip 4 mounted on the other end, at the bottom end of the shaft 2. As shown with the dotted lines in FIGS. 8 and 9, when the entire putter club 1 is considered to be a single rigid body as discussed above, the reaction from the golf ball 5 acts as a force causing the putter club 1 (shaft 2) to move around the center of rotation P in a direction opposite to the direction of the putt, at the time of impact during putting.

Consequently, as shown in FIG. 9, a force causes the putter club 1 to rotate in a clockwise direction in the figure around the center of rotation P. This force acts on the hand 7 of the golfer who is holding the grip area 6 and putting. As a result, the golfer putts while this force is acting and the force (or direction, in some cases) imagined by the golfer is somewhat different from the actual force or direction. This makes it difficult to execute correct putting.

In the conventional putter club 1 as shown in FIG. 8, the grip area 6 of the grip 4 is located closer to the grip end 8 than the center of rotation P and the center of rotation P is located on the upper portion of the shaft 2 close to the grip 4. As a result, the counteraction from the golf ball 5, during putting as discussed above, causes the reaction force A of the grip end 8 (shown as a certain size in the figure for purposes of clarity) to become large. The counteraction against the hand 7 of the golfer thereby acts more strongly and easily gives rise to unintentional movement. Furthermore, golfers demand various properties of putter clubs 1, such as gently or firmly striking with the sense of distance imagined by the golfer. Before now, these demands have been difficult to meet on the basis of a correct standard.

SUMMARY OF THE INVENTION

In view of the foregoing, it is an object of the present invention to provide a putter club which can minimize the reaction from the golf ball during putting.

It is another object of the present invention to provide a putter club which can reduce the operating force for counteracting the shock at the instant of putting.

It is another object of the present invention to provide a putter club which can effectively and appropriately transmit the putting force to the golf ball.

It is another object of the present invention to provide a putter club whereby a golfer can get an appropriate feel for the sense of distance or power during putting.

It is another object of the present invention to provide a putter club which can be manufactured on the basis of a prescribed standard according to the various requirements of a golfer.

Specifically, the present invention gives attention to locating the center of rotation (center of instantaneous shock or impact) of the putter club during putting on the grip (especially on the grip area), minimizing with that arrangement the reaction from the putter club to the hand, and making it easy to control the putter club as a whole. The first invention is a putter club comprising a shaft, a putter head mounted on one end of this shaft, and a grip mounted on the other end of this shaft, wherein the center of rotation of the club during putting is located on the aforementioned grip.

The second invention is a putter club comprising a shaft, a putter head mounted on one end of this shaft, and a grip mounted on the other end of this shaft, wherein the center of rotation of the club during putting congruent to the grip area of the aforementioned grip.

The third invention is a putter club comprising a shaft, a putter head mounted on one end of this shaft, and a grip mounted on the other end of this shaft, wherein the distance between the center of gravity of the entire club and the center of rotation of the club during putting is 4/10 to 6/10 of the total length of the club. Consequently, it is possible to calculate the appropriate position of the center of rotation by subtracting the distance between the center of rotation and center of gravity of the whole from the position of the center of gravity, in relation to the grip end of the grip.

The fourth invention is a putter club comprising a shaft, a putter head mounted on one end of this shaft, and a grip mounted on the other end of this shaft, wherein the distance between the center of gravity of the whole and the grip area of the aforementioned grip is 4/10 to 6/10 the length of the whole.

Consequently, it is possible to calculate the appropriate position of the grip area by subtracting the distance between the grip area and the center of gravity of the whole from the center of gravity, in relation to the grip end of the grip.

The fifth invention is a putter club comprising a shaft, a putter head mounted on one end of this shaft, and a grip mounted on the other end of this shaft, wherein the distance between the center of gravity of the whole and the center of rotation of the club during putting is the same as the distance between the center of gravity of the whole and the grip area of the aforementioned grip.

The sixth invention is a putter club comprising a shaft, a putter head mounted on one end of this shaft, and a grip mounted on the other end of this shaft, wherein the distance between the grip end of the aforementioned grip and the center of rotation of the club during putting is the same as the distance between this grip end and the grip area of the aforementioned grip.

The position of the aforementioned center of rotation can be adjusted by varying the mass or length of the aforementioned shaft, putter head, or grip.

The position of the aforementioned center of rotation can be adjusted by the placement of auxiliary weights which can be installed at any area on the aforementioned shaft, as well as by varying the length or mass of the auxiliary weights, the aforementioned shaft, putter head, or grip.

The position of the aforementioned center of rotation can be adjusted by varying the mass distribution of the aforementioned shaft, putter head, or grip.

For example, the mass distribution of the whole can be adjusted by adjusting the thickness of each area along the length of the putter club.

In the putter club relating to the present invention, the center of rotation during putting is located on part of the grip, specifically the grip area. The amount of shock, caused by the reaction from the golf ball during putting, transmitted to the hand can therefore be reduced as much as possible, as can the reaction force of the grip end at the grip. Specifically, the reaction from the putter club acting on the hand of the golfer doing the putting can be minimized.

Consequently, the counteraction from the golf ball following putting is greatly suppressed. The golfer doing the putting thereby does not need to apply unnecessary force, or force wasted in countering the reaction, to putting and needs only to apply the force necessary for putting the golf ball; a golfer can thereby make a putt matching his/her visualization and imagined intensity. The action discussed above can effectively transmit the operating force of putting to the golf ball and maximizes the efficiency of the transmission of force to the golf ball. The sweet spot, lengthwise to the shaft of the club is adjusted appropriately. Furthermore, because the general sweet spot on the face of the putter head is enlarged, the putting action is made easy and a golfer can put with a good feel for distance and with correct imagery. Figuratively speaking, this putter gives a golfer the sense of striking the golf ball with his/her own hand, instead of with a putter.

Moreover, putting clubs with the feel golfers want can be made by adjusting the congruency of the center of rotation and grip area, the distance between the center of rotation and center of gravity of the whole, the distance between the grip area and center of gravity of the whole, or the position of the center of rotation itself. Furthermore, the third and fourth inventions can result in a well-balanced club with easy putting action, because the distance between the center of gravity of the whole and the center of rotation of the putter club or the distance between the center of gravity of the whole and the grip area is 4/10 to 6/10, about ½ for example, of the total length.

The fifth and sixth inventions can provide well-balanced putter clubs with an easy swing, because the distance between the center of rotation and center of gravity of the whole is the same as the distance between the center of gravity and the grip area, or the distance between the center of rotation and the grip end is the same as the distance between the grip area and the grip end.

In a putter club according to the present invention, the shaft may be a shaft of steel or other material, or even a carbon shaft, which is rarely used in conventional putters, so long as the shaft itself has the rigidity to transmit putting force from the action of the hand to the putter head or golf ball. A putter club having the light weight and other properties golfers want can thereby be created.

DESCRIPTION OF THE PREFERRED EMBODIMENTS

Next, FIGS. 1 through 7 are used to explain a putter club 10 which is an embodiment of the present invention. The same symbols are used for portions identical to those in FIGS. 8 and 9 and details thereof are omitted here.

Figure 1:
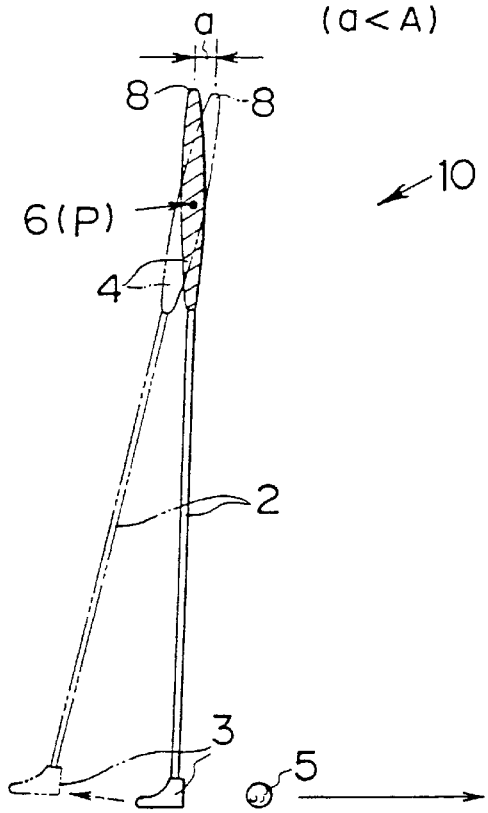
FIG. 1 is a side view of a putter club 10, according to an embodiment of the present invention, during putting.
Figure 2:
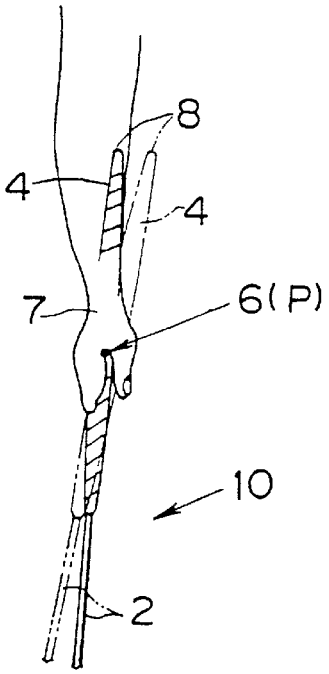
FIG. 2 is a detail of the principal elements during impact of a putter club 10, according to an embodiment of the present invention.
Figure 8:
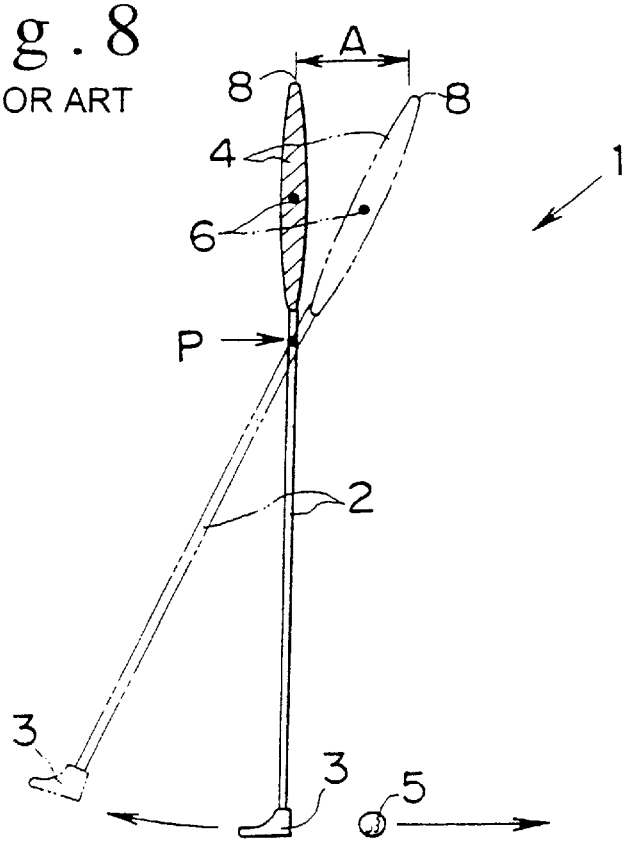
Fig. 8 PRIOR ART
FIG. 8 is a side view of a conventional putter club 1 during putting.

FIG. 1 is a side view of the putter club 10 at the time of putting, like FIG. 8. FIG. 2 is a detail of principal elements at the time of impact. Like the conventional putter club 1 (FIG. 8), the putter club 10 comprises at least a shaft 2, a putter head 3, and a grip 4; the center of rotation P is congruent to the grip area 6 on the grip 4.

Specifically, if a person is right handed, the grip area 6 is the portion held by the thumb of the left hand overlapped by the palm of the right hand. The center of rotation P of the putter club 10 during putting is located on this grip area 6.

With a putter club 10 having such a structure, a force, causing the putter club 1 to rotate clockwise in the figure around the center of rotation P, acts on the hands of a golfer putting with a hold on the grip area 6 and putting, as shown in FIGS. 1 and 2. However, because the golfer is holding the center of rotation itself, the reaction force a of the grip end 8 is lower and the reaction from the golf ball 5 on the hands 7 of the golfer is less than in the conventional case shown in FIG. 8.

Consequently, the direction and force, operating in the putting direction and at the power visualized by the golfer, can be transmitted correctly from the golfer's hands 7 to the putter club 10. Appropriate putting can thereby be performed.

Figures 3, 4:
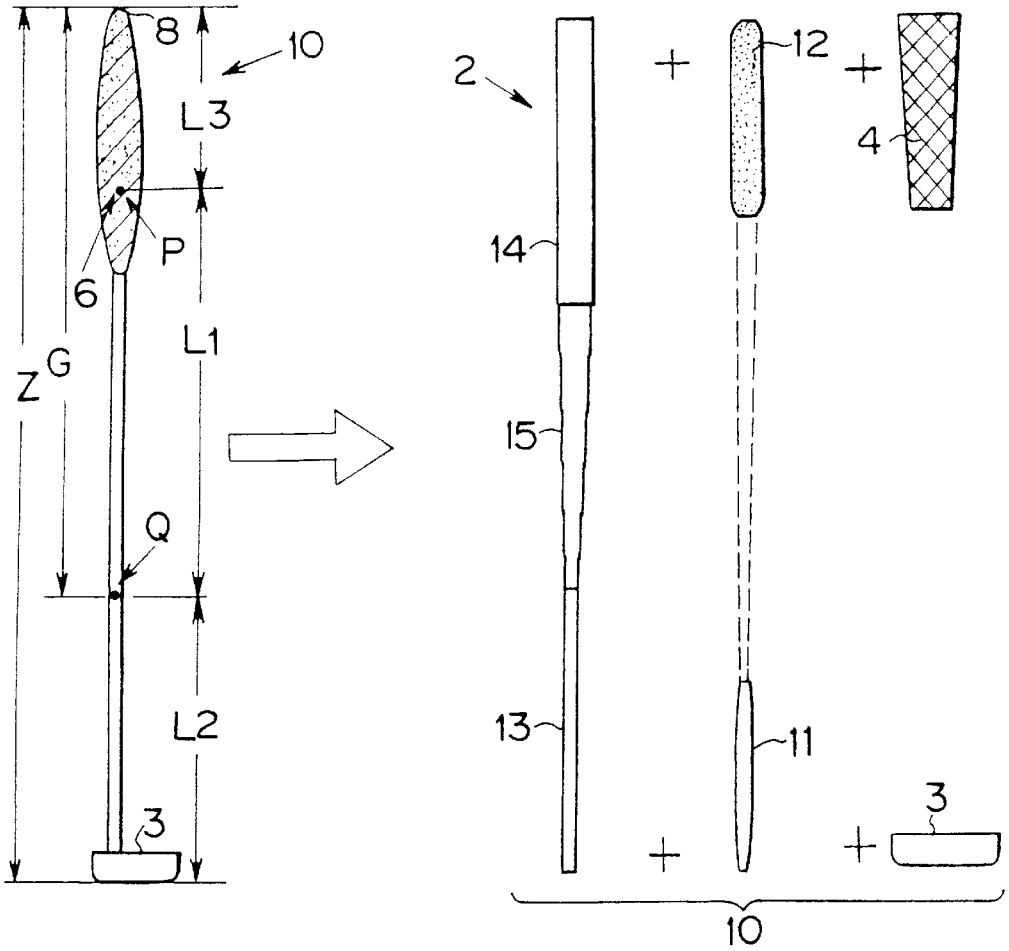
FIG. 3 is a side view showing an exploded view of each portion of the putter club 10, for a putter club 10, according to an embodiment of the present invention.
FIG. 4 is a figure showing the following equations: equation (1) (distance L1 from the center of gravity Q to the center of rotation P), equation (2) (moment of inertia I), equation (3) (distance G from the grip end 8 to the center of gravity Q), and equation (4) (distance L3 from the grip end 8 to the center of rotation P) for an embodiment of the present invention.

The method for adjusting the center of rotation P and calculating its position are explained on the basis of FIGS. 3 and 4.

FIG. 3 is a side view showing an exploded view of the elements of the putter club 10. The putter club 10 comprises a shaft 2, putter head 3, and grip 4, as well as auxiliary weights (head side auxiliary weight 11 and grip side auxiliary weight 12) which can be mounted within the shaft 2.

The head side auxiliary weight 11 and grip side auxiliary weight 12 may both be mounted or either one may be mounted alone. Moreover, the constitution of the shaft 2 is arbitrary and, for example, may comprise a tip portion 13 mounted on the putter head, a pad portion 14 mounted on the grip 4, and a tapered portion 15 therebetween.

L1 represents the distance from the center of gravity Q of the putter club 10 to the center of rotation P. As shown in equation (1) in FIG. 4, this distance L1 can be attained from the moment of inertia I of the putter club 10 around the center of gravity Q, the mass M of the putter club 10, and the distance L2 from the putter head 3 to the center of gravity Q.

As shown in equation (2), the moment of inertia I can be attained from the mass $m_i$ of the elements constituting the putter club 10, the distance $d_i$ from the grip end 8 to the elements with this mass $m_i$, the mass M of the putter club 10, and the distance G from the grip end 8 of the putter club 10 to the center of gravity Q.

As shown in equation (3), the distance G from the grip end 8 to the center of gravity Q can be attained from the mass $m_i$ of the elements constituting the putter club 10, the distance $d_i$, from the grip end 8 to the elements with this mass $m_i$, and the mass M of the putter club 10.

Consequently, as shown in equation (4), the distance L3 from the grip end 8 of the grip 4 to the center of rotation P can be attained from the length Z of the entire putter club 10, the distance L1 from the center of gravity Q to the center of rotation P, and the distance L2 from the putter end 3 to the center of gravity Q. The distance L1 from the center of gravity Q to the center of rotation P and the distance L3 from the grip end 8 to the center of rotation P are functions of the distance or length and the position and mass of each element of the putter club 10. The mass distribution is adjusted by appropriate selection of these elements and the center of rotation P can thereby be made congruent to the position of the grip area 6.

The many elements constituting the putter club 10 include a shaft 2, putter head 3, grip 4, head side auxiliary weight 11, grip side auxiliary weight 12. It is therefore practical to make an appropriate selection of the position, mass, and length of the head side auxiliary weight 11 and grip side auxiliary weight 12, and make adjustments thereto using a simulation.

The head side auxiliary weight 11 and grip side auxiliary weight 12 are generally mounted within the shaft 2, but can also be mounted on the outer surface thereof. Naturally the head side auxiliary weight 11 and grip side auxiliary weight 12 can be selected to suit variations of the shaft 2, putter head 3, and grip 4.

The mass distribution of the entire putter can be varied by the choice of the thickness of each portion (tip portion 13, pad portion 14, and tapered portion 15) of the shaft 2 or the thickness of the grip 4. The center of rotation P can also be adjusted to a position on part of the grip 4.

For example, the mass distribution can be adjusted by making the tip portion 13 on the putter head side 3 of the shaft 2 relatively thin while making the pad portion 14 on the grip 4 relatively thick. Furthermore, an auxiliary weight (not shown) may also be mounted on the grip end 8 of the grip 4. Moreover, these auxiliary weights, including the head side auxiliary weight 11 and grip side auxiliary weight 12, may be made of any material, but lead or other material with a comparatively large specific gravity is preferable.

Figure 5:
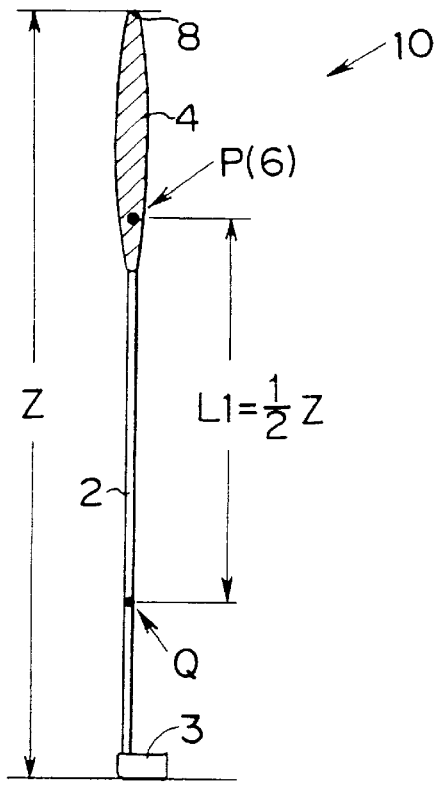
FIG. 5 is a side view of the putter club 10 showing an example of the adjustment of the center of rotation P to the grip area 6, for an embodiment of the present invention.

FIG. 5 is a side view of a putter club 10 showing an example of the case where the center of rotation P is adjusted to the grip area 6 in this manner. The distance L1 from the center of gravity Q to the center of rotation P is preferably 4/10 to 6/10(1/2, for example) of the total length of the putter club 10. It is thereby possible to give the putter good balance and an easy swing. According to a golfer's requirements, the space between this center of rotation P and grip area 6 can be varied slightly to make a sensitive putter club 10. In this case, the length between the grip area 6 and the center of gravity Q is preferably 4/10 to 6/10(1/2, for example) the length Z of the whole.

Figure 6:
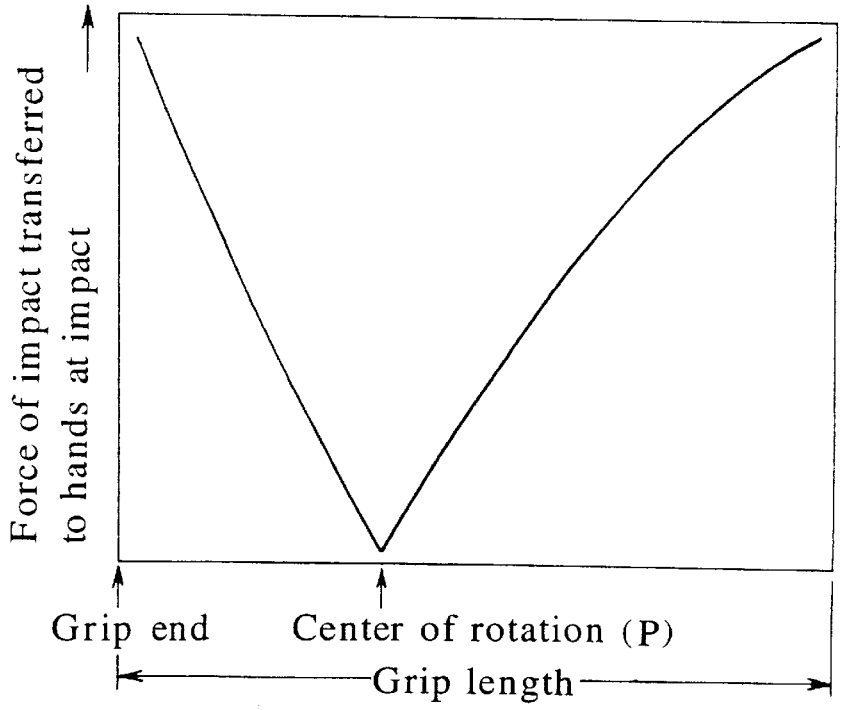
FIG. 6 is a graph (graph showing the relationship between the shock and the distance from the grip end 8) of the shock during putting with the center of rotation P at various positions in the grip 4 for an embodiment of the present invention.

FIG. 6 is a graph (graph showing the relationship between the shock and the distance from the grip end 8) of the shock during putting with the center of rotation P at various positions in the grip 4. It was found that the shock from the golf ball during putting was minimized at a given position (center of rotation P) on the grip 4.

Figure 9:
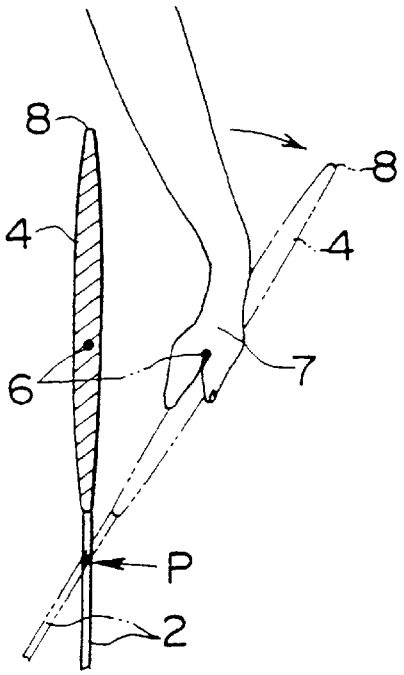
Fig. 9 PRIOR ART
FIG. 9 is an enlargement of the principal elements of the conventional putter club 1 at the time of impact.

In other words, the reaction from the golf ball 5 due to the impact is transmitted through the putter club 10 and returns from the grip area 6 to the hands 7 of the putting golfer. This sensation is of only the force of the putting action and does not include any sense of force wasted in suppressing the reaction (in effect, without requiring the operation of suppressing the reaction as shown in FIGS. 8 and 9). This gives the golfer a sense of putting more correctly and as visualized.

The movement of the center of rotation P to the grip area 6 in the grip 4 in this manner optimizes the sweet spot axially with respect to the putter club 10. Even if the point of impact of the putter head 3 during putting is slightly shifted in an axial direction, the operating force can be transmitted correctly; and the sweet spot is thereby more expansive than in conventional putters.

Figure 7:
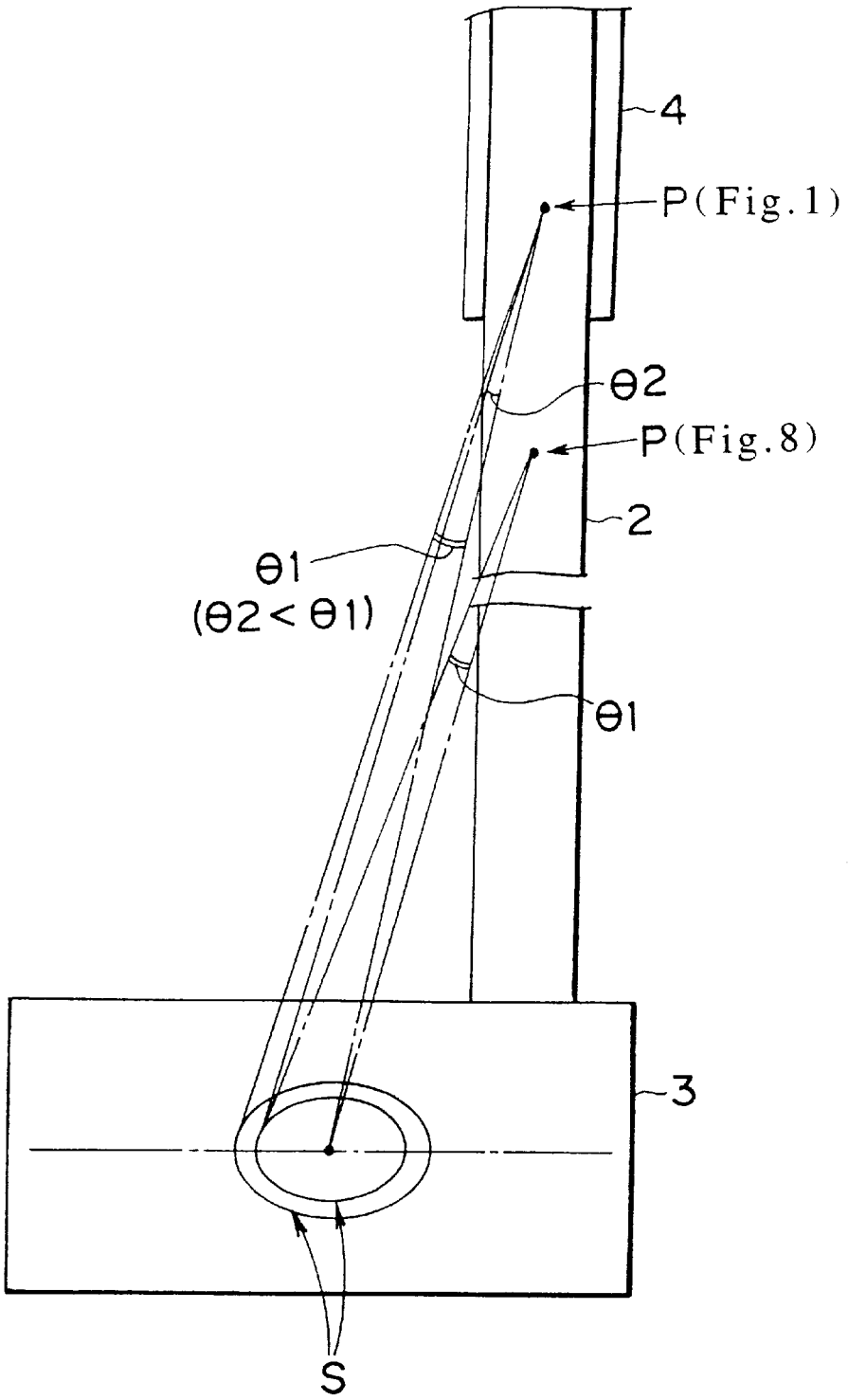
FIG. 7 is a side view showing a detail of the sweet spot S, on the face of a putter head 3, in relation to the movement of the center of rotation P from the shaft 2 to the grip 4 for an embodiment of the present invention.

Specifically, FIG. 7 is a figure showing the expansion of the sweet spot S on the impact surface of the putter head 3 due to the movement of the center of rotation P from the shaft 2 to the grip 4. When the center of rotation P is on the shaft 2 as in conventional examples (FIG. 8) , the angle θ1 formed by the spread of the sweet spot S is greater than the angle θ2 formed by the spread of the sweet spot S when the center of rotation P is on the grip area 6.

Consequently, if the angle θ1 from the center of rotation P on the grip area 6 is drawn to the impact surface of the putter head 3, it covers a wider area than the angle θ2 and can enlarge the sweet spot S on the impact surface of the putter head 3.

In this way, the sweet spot S, enabling appropriate and correct putting, can be enlarged in both the axial direction of the putter club 10 and on the impact surface of the putter head 3. More sensitive putting can thereby be realized.

Moreover, various adjustments to the center of rotation P on the grip 4 can make the putter club 10 more sensitive to the characteristics and habits of a golfer.

The present invention as discussed above can realize more correct and appropriate putting because the center of rotation of the putter club during putting is located on the grip. This reduces unintentional movement of the entire putter club because of reaction to the hands from the golf ball and can transmit the putting force effectively to the golf ball.

In other words, the sweet spot of the putter head and the sweet spot in the lengthwise direction of the putter club can be made to match correctly with the center of the hands; also, the reaction force applied to the hands by the shock during putting is minimized. A golfer thereby gets correct feedback to his/her visualization of the putt and the energy of the putting action can be transmitted with maximum efficiency.

What is claimed is:

1. A putter club comprising:

a shaft having opposite top and bottom ends;

a putter head mounted on said bottom end of said shaft; and a grip area defined at said top end of said shaft, wherein said shaft, grip area and putter head define a total length, Z and wherein the center of instantaneous impact of said putter club upon impact of said putter head against a golf ball during putting is located on said grip area.

2. A putter club according to claim 1, wherein the distance between said grip area and the center of gravity of said putter club is 4/10 to 6/10 of said total length, Z.

3. A putter club comprising:

a shaft having opposite top and bottom ends;

a putter head mounted on said bottom end of said shaft; and a grip area defined at said top end of said shaft;

wherein the center of instantaneous impact of said putter club upon impact of said putter head against a golf ball during putting is congruent to said grip area.

4. A putter club according to claim 3, wherein the distance between said grip area and the center of gravity of said putter club is 4/10 to 6/10 of said total length, Z.

5. A putter club comprising:

a shaft having opposite top and bottom ends;

a putter head mounted on said bottom end of said shaft; and a grip area defined at said top end of said shaft, wherein said shaft, grip area and putter head define a total length, Z and wherein the distance between the center of instantaneous impact of said putter club upon impact of said putter head against a golf ball during putting and the center of gravity of said putter club is 4/10 to 6/10 of said total length, Z.

6. A putter club comprising:

a shaft having opposite top and bottom ends;

a putter head mounted on said bottom end of said shaft; and a grip area defined at said top end of said shaft;

wherein the distance between the center of instantaneous impact of said putter club upon impact of said putter head against a golf ball during putting and the center of gravity of said putter club is the same as the distance between said grip area and said center of gravity of said putter club.

7. A putter club comprising:

a shaft having opposite top and bottom ends;

a putter head mounted on said bottom end of said shaft; and a grip at said top end of said shaft, said grip terminating in a grip end a grip area on said grip down said shaft from said grip end;

wherein the distance between the center of instantaneous impact of said putter club upon impact of said putter head against a golf ball during putting and said grip area is the same as the distance between said grip area and said grip end.

8. The putter club according to claims 1, 3, 5, 2, 6, 7 or 4 wherein the position of said center of instantaneous impact is adjustable by varying the length or mass of said shaft, said putter head, or said grip area.

9. The putter club according to claims 1, 3, 5, 2, 6, 7 or 4 wherein auxiliary weights are established at arbitrary locations on said shaft, and the position of said center of instantaneous impact is adjustable by varying the length or mass of said auxiliary weights, said shaft, said putter head, or said grip area.

10. The putter club according to claims 1, 3, 5, 2, 6, 7 or 4 wherein the position of said center of instantaneous impact is adjustable by varying the mass distribution of said shaft, said putter head, and/or said grip area.

* * * * *